US007131714B2

(12) United States Patent
Edelen et al.

(10) Patent No.: US 7,131,714 B2
(45) Date of Patent: Nov. 7, 2006

(54) N-WELL AND OTHER IMPLANTED TEMPERATURE SENSE RESISTORS IN INKJET PRINT HEAD CHIPS

(75) Inventors: John G. Edelen, Versailles, KY (US); George K. Parish, Winchester, KY (US); Kristi M. Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/655,363

(22) Filed: Sep. 4, 2003

(65) Prior Publication Data

US 2005/0052500 A1 Mar. 10, 2005

(51) Int. Cl.
*B41J 29/38* (2006.01)

(52) U.S. Cl. ..... 347/17; 347/62

(58) Field of Classification Search ..... 347/17, 347/59, 62

See application file for complete search history.

(56) References Cited

U.S. PATENT DOCUMENTS

| | | | | |
|---|---|---|---|---|
| 4,772,866 | A | 9/1988 | Willens | |
| 5,136,305 | A | 8/1992 | Ims | |
| 5,300,968 | A | 4/1994 | Hawkins | |
| 5,942,900 | A | 8/1999 | DeMeerleer et al. | |
| 5,984,455 | A | 11/1999 | Anderson | |
| 6,102,515 | A | 8/2000 | Edwards et al. | |
| 6,154,229 | A | 11/2000 | Corrigan | |
| 6,171,880 | B1 | 1/2001 | Gaitan et al. | |
| 6,299,273 | B1 | 10/2001 | Anderson et al. | |
| 6,336,713 | B1 | 1/2002 | Regan et al. | |
| 6,357,863 | B1 | 3/2002 | Anderson et al. | |
| 6,371,589 | B1 * | 4/2002 | Conta et al. | 347/14 |
| 6,382,758 | B1 | 5/2002 | Chausanski et al. | |
| 6,398,346 | B1 | 6/2002 | Anderson et al. | |
| 6,441,680 | B1 | 8/2002 | Leung et al. | |
| 6,443,558 | B1 | 9/2002 | Silverbrook | |
| 6,450,622 | B1 | 9/2002 | Nguyen et al. | |
| 6,540,334 | B1 | 4/2003 | Mrvos et al. | |
| 6,565,177 | B1 | 5/2003 | Corrigan, III | |
| 2001/0050410 | A1 * | 12/2001 | Aswell | 257/536 |
| 2002/0060333 | A1 * | 5/2002 | Tanaka et al. | 257/299 |
| 2002/0149657 | A1 * | 10/2002 | Ishinaga et al. | 347/100 |

OTHER PUBLICATIONS

Stanley Wolf, Silicon Processing for the VLSI Era, 1990, Lattice Press, Vol. 2, pp. 354-356.*

* cited by examiner

*Primary Examiner*—Lamson Nguyen
(74) *Attorney, Agent, or Firm*—Dinsmore & Shohl LLP

(57) ABSTRACT

An inkjet print head chip having MOS logic blocks that also includes temperature sense resistors implanted in the chip. These resistors are preferably made of N-Well material.

31 Claims, 1 Drawing Sheet

N-WELL AND OTHER IMPLANTED TEMPERATURE SENSE RESISTORS IN INKJET PRINT HEAD CHIPS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to printers. More particularly, the present invention relates to ink jet printers.

2. General Background of the Invention

Inkjet print heads require well-controlled substrate temperature to maintain a consistent ink viscosity and jetting performance. Previous designs include a temperature sense resistor (TSR) integrated into the heater chip to monitor the substrate temperature. The chip also has designated resistor elements to heat the substrate as necessary. The resistor elements may have dedicated power FETs to control the substrate heater resistors, as in Lexmark's U.S. Pat. No. 6,102,515 (incorporated herein by reference). Some designs may use the inkjet resistors themselves for substrate heating, if the on-time is less than the bubble nucleation threshold, as practiced by Hewlett-Packard. The printer control unit periodically monitors the temperature sense resistor to determine the substrate temperature. Then the control unit turns the substrate heaters on and off, accordingly, to maintain the proper substrate temperature for optimum jetting performance.

The temperature sense resistor value follows the equations:

$$R_T = R_{ambient} * (1 + (\alpha * (T - T_{ambient})))$$

$$R_{ambient} = R_{S\ ambient} * (L/W)$$

where R=resistance of the TSR $\alpha$=temperature coefficient of resistivity, (Ω/° C.), T=temperature, (° C.), and $R_s$=sheet resistance, (Ω/□).

L=length of the TSR material, (μm)

W=width of the TSR material, (μm)

Based on this knowledge, the TSR is selected to have a large positive temperature coefficient ($\alpha$) and a large resistance (R). In the past, the resistor material has typically been chosen to be a metal (AlCu). While metal may have a relatively large positive temperature coefficient, its TSR design is limited by the ability to route enough metal around the chip to get a high enough resistance for easy temperature change detection (see metal resistor 20 in inkjet print head chip 220 in FIG. 1). Typical TSR resistances have been 500–1000 ohms. A 500-Ω TSR, for example, will have a resistance change of approximately 2 Ω/° C. A 1000-Ω TSR, for example, will have a resistance change of approximately 3.5 Ω/° C. Metal TSRs are also limited by the wide tolerance range that can occur. The only way to increase the resistance of a metal TSR is to make the trace longer or the width smaller. Making the TSR longer, takes up silicon area. Making the TSR width smaller, widens the tolerance band, due to process variations in width. For example, a TSR 2 μm (2 microns) wide, with 0.1 μm over-etch on each side will be 1.8 μm wide, a loss of 10% of drawn width. A TSR 20 μm wide, with 0.1 μm over-etch on each side will be 18.8 μm wide, of loss of 1% of drawn width. These are some of the issues currently involved with metal TSR designs.

The following U.S. patents, and all patents mentioned herein, are incorporated herein by reference:

U.S. Pat. Nos. 6,450,622; 6,443,558; 6,441,680; 6,382,758; 6,336,713; 6,171,880; 6,102,515; 5,300,968; 5,136,305.

U.S. Pat. No. 6,336,713 discloses a thermal inkjet printhead which uses metal silicon nitride resistors as heaters. This patent mentions that resistors having high bulk resistivity are desirable for use in thermal inkjet printing units, and that the resistors disclosed therein have high bulk resistivity (see column 8, lines 29).

U.S. Pat. No. 6,443,558 discloses an inkjet printhead having a thermal bend actuator with a separate titanium nitride heater element. It includes N-well transistors (see column 15).

U.S. Pat. No. 6,171,880 discloses a meandering polysilicon heater mounted on an IC CMOS chip. See column 4, lines 12–18 and 34–41, and column 5, lines 7–36 (fabricated in a CMOS N-well operation).

U.S. Pat. No. 6,382,758 discloses an inkjet printhead having TSRs 14 (see column 3, lines 1–5).

U.S. Pat. No. 6,450,622 discloses a print head with a semiconductor substrate that has an N-well layer, but uses TaAl resistors (see column 3, lines 6–7 and 44–46).

U.S. Pat. No. 5,136,305 discloses controlling heat to ink reservoirs for inkjet printheads using temperature sensitive resistors (see column 4, lines 30–38).

U.S. Pat. No. 5,300,968 discloses a lightly n-doped resistor or a heavily n+doped polysilicon resistor (both of which have high sheet resistance and high temperature coefficient of resistance) in a temperature compensating circuit in an inkjet printhead (see column 5, line 65 through column 6, line 30).

U.S. Pat. No. 6,441,680 discloses a CMOS reference voltage generator using p-type and n-type CMOS transistors. It discusses temperature dependence of these transistors (see, for example, column 4, lines 8–20).

BRIEF SUMMARY OF THE INVENTION

The present invention focuses on the temperature sensitive resistor (TSR) in inkjet print heads. More specifically, the present invention comprises TSRs made of implants (such as of N-well material) in inkjet print heads, inkjet print heads including these TSRs, and inkjet printers including these inkjet print heads.

The present invention includes an inkjet print head chip having MOS logic blocks, resistor elements to heat the chip, and a controller of the resistor elements, and temperature sense resistors implanted in the chip, the temperature sense resistors being operatively connected to the controller of the resistor elements to enable the controller to monitor the chip temperature to control the resistor elements to heat the chip.

The present invention also includes a method of controlling the temperature of an inkjet print head chip having MOS logic blocks, comprising providing the print head chip with at least one substrate heater to heat the chip, providing the print head chip with a controller of the substrate heater, implanting temperature sense resistors in the chip, operatively connecting the temperature sense resistors to the controller of the substrate heater to enable the controller to monitor the chip temperature to control the substrate heater to heat the chip, and using the controller to control the substrate heater to heat the chip.

The temperature sense resistors preferably have a sheet resistance of at least 20 Ω/□ and a temperature coefficient of resistivity of at least 0.0010 Ω/° C. More preferably, the temperature sense resistors have a sheet resistance of at least 75 Ω/□ and a temperature coefficient of resistivity of at least 0.0020 Ω/° C. Even more preferably, the temperature sense resistors have a sheet resistance of at least 500 Ω/□ and a temperature coefficient of resistivity of at least 0.0030 Ω/° C. Most preferably, the temperature sense resistors have a sheet resistance of at least 1000 Ω/□ and a temperature coefficient of resistivity of at least 0.0040 Ω/° C.

The temperature sense resistors preferably comprise N-Well material, but could also comprise NSD material, LDD material, or PSD material, for example. An inkj et print head chip can include, for example, 1–1000 temperature sense resistors of the present invention.

Typically, each temperature sense resistor can be 0.05–5000 μm wide by 0.01–400,000 μm long by 0.05–4 μm thick. Preferably, each temperature sense resistor is 1–2000 μm wide by 1–200,000 μm long by 0.1–3 μm thick. More preferably, each temperature sense resistor is 2–1000 μm wide by 2–100,000 μm long by 0.2–2 μm thick.

In the present invention, the MOS logic blocks are preferably CMOS logic blocks.

The novel TSRs of the present invention can be used in various types of ink jet printers (such as Lexmark® Model Z51, Lexmark® Model Z31, and Lexmark® Model Z11, Lexmark® Photo Jetprinter 5770, or Kodak® PPM200).

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

The present invention comprises TSRs 10 (FIG. 2) made of implants (preferably N-well material) in a print head chip 110, inkjet print heads 120 (FIG. 3) including these TSRs 10, and inkjet printers 130 (FIG. 4) including these print heads 120.

Figure 1:
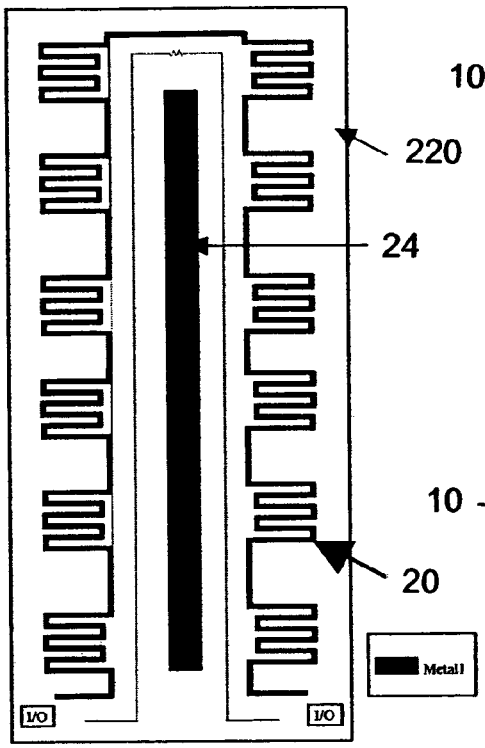
FIG. 1 (Prior Art)
FIG. 1 is a schematic view (not to scale) of a prior art metal TSR design.

FIG. 1 shows a prior art print head chip 220 including an ink via 24 surrounded by a meandering metal TSR 20.

With the introduction of CMOS logic, N-Well material was added for the ability to create PMOS transistors in the CMOS logic blocks. N-Well is one of the most resistive materials on Lexmark CMOS print head chips and has a larger temperature coefficient than AlCu (see Table 1 below). Other implants listed are: NSD (n-type implant used for NMOS transistor source and drain areas), LDD (n-type implant used to form the lightly doped drain side of an n-type transistor), and PSD (p-type implant used for PMOS transistor source and drain areas).

TABLE 1

Comparison of N-Well Diffusion and other implants and AlCu Temperature Coefficients and Resistivities

| | α (Ω/° C.) | $R_S$ (Ω/□) |
|---|---|---|
| N-Well | .0051 | 1200 |
| NSD | .0022 | 36 |
| LDD | .0030 | 2100 |
| PSD | .0013 | 86 |
| Aluminum-Copper | .0036 | .05 |

Figure 2:
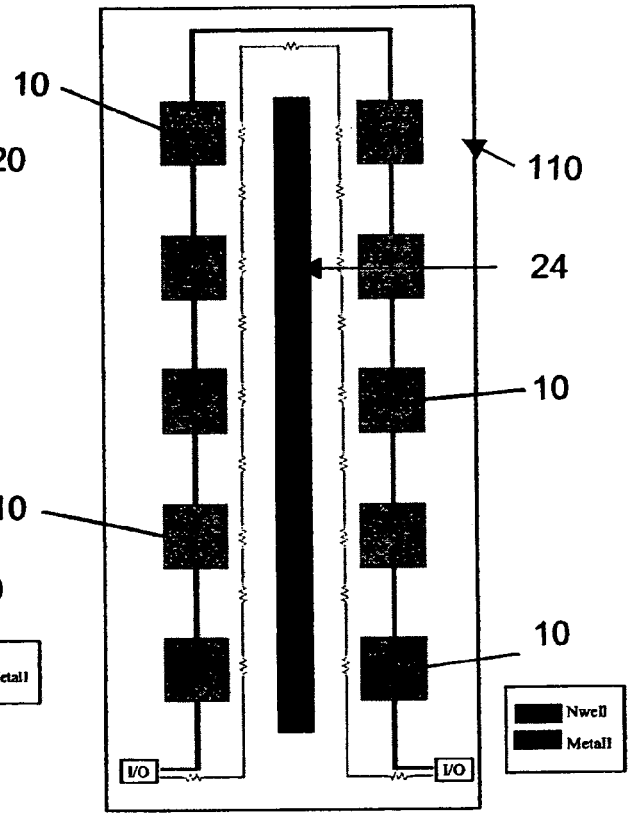
FIG. 2 is a schematic view (not to scale) of a preferred embodiment of the TSR of the present invention on an inkjet print head chip of the present invention.

FIG. 2 shows an inkjet print head chip 110 of the present invention including an ink via 24 surrounded by TSRs 10 made of implants (preferably N-well material) in print head chip 110.

By using N-Well for the TSR material, the following improvements over prior art metal TSR will result:

1.) N-Well has a higher temperature coefficient, α. Therefore, temperature changes are easier to detect.

2.) N-Well has a higher resistance R. Therefore, more precise measurements can be made and temperature is even easier to detect because changes in resistance are so much bigger.

3.) Larger blocks of material can be used, which will provide a tighter tolerance on the resistance since there is less effect from line width process variations.

4.) The larger blocks of N-Well can overlap other metal traces with no functional effect, which can save silicon area.

While N-Well is the preferred implant for TSRs, many implants (such as NSD, LDD, and PSD) used in the geometry shown in FIG. 2 will provide the same advantages over metal TSRs, and are included in the scope of the present invention.

The novel TSRs of the present invention can be used in various types of ink jet print heads, such as those shown in Lexmark's U.S. Pat. Nos. 6,398,333 and 6,382,758 (both incorporated herein by reference).

The novel TSRs of the present invention can be produced in a print head chip by the following method: Ion implantation of donor or acceptor atoms, followed by a thermal diffusion cycle, or by any standard method for producing MOS print head chips known to those of ordinary skill in this art.

The print head chip 120 of the present invention will typically contain 1–1000 TSRs 10 of the present invention. Each of these TSRs (when made of N-well material) can be, for example, 6–1000 μm wide by 6–100,000 μm long by 1–2 μm thick. Each of these TSRs (when made of NSD material) can be, for example, 2–1000 μm wide by 2–100,000 μm long by 0.4–0.8 μm thick. Each of these TSRs (when made of LDD material) can be, for example 2–1000 μm wide by 2–100,000 μm long by 0.2–0.4 μm thick. Each of these TSRs (when made of PSD material) can be, for example, 2–1000 μm wide by 2–100,000 μm long by 0.4–0.8 μm thick.

Aside from the novel TSRs of the present invention, print head chip 110 can be the same as chip 10 of Lexmark's U.S. Pat. Nos. 6,540,334; 6,398,346; 6,357,863; 5,984,455; 5,942,900.

Figure 3:
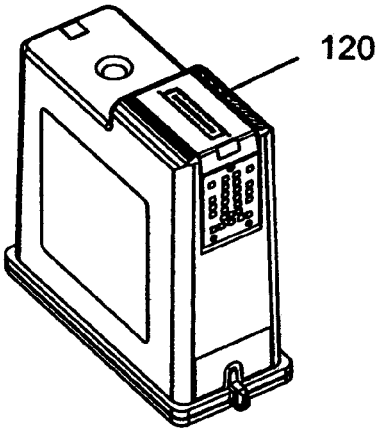
FIG. 3 shows a preferred embodiment of an inkjet print head of the present invention including an inkjet print head chip of the present invention.
Figure 4:
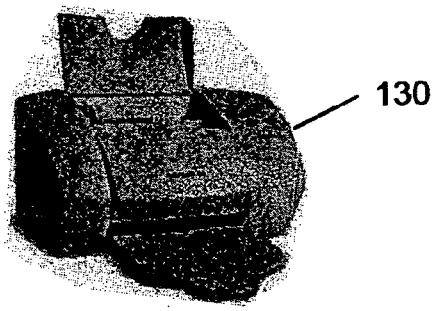
FIG. 4 shows a preferred embodiment of the inkjet printer of the present invention.

FIG. 3 shows an inkjet print head 120 of the present invention. FIG. 4 shows an inkjet printer 130 including print head 120. Aside from the novel TSRs of the present invention, printer 130 can be the same as current Lexmark printers (such as Lexmark® Model Z51, Lexmark® Model Z31, and Lexmark® Model Z11).

The present invention includes an inkjet print head chip 110 having MOS logic blocks (CMOS, NMOS, or PMOS logic blocks), resistor elements to heat the chip, and a controller of the resistor elements and temperature sense resistors 10 implanted in the chip, the temperature sense resistors 10 being operatively connected to the controller of the resistor elements to enable the controller to monitor the chip temperature to control the resistor elements to heat the chip. For elements of the present invention not shown herein, see one or more of the U.S. patents mentioned herein (e.g., Lexmark U.S. Pat. No. 6,299,273), all of which are incorporated herein by reference.

PARTS LIST

The following is a list of parts and materials suitable for use in the present invention:

10 temperature sense resistors of a first embodiment of the present invention

20 prior art metal temperature sense resistor

24 ink via

110 inkjet print head chip of a first embodiment of the present invention

120 inkjet print head of the present invention

130 inkjet printer including print head 120

220 prior art inkjet print head chip

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. Apparatus comprising:

inkjet print head chip having a silicon substrate and MOS logic blocks, resistor elements to heat the chip, and a controller of the resistor elements; and temperature sense resisters implanted in the silicon substrate of the print head chip and comprising atoms of an implantation material, wherein the atoms of the implantation material are embedded beneath the substrate surface, the temperature sense resistors being operatively connected to the controller of the resistor elements to enable the controller to monitor the chip temperature to control the resistor elements to beat the chip.

2. The apparatus of claim 1, wherein the temperature sense resistors have a sheet resistance of at least 20 Ω/□ and a temperature coefficient of resistivity of at least 0.0010 Ω/° C.

3. The apparatus of claim 1, wherein the temperature sense resistors have a sheet resistance of at least 75 Ω/□ and a temperature coefficient of resistivity of at least 0.0020 Ω/° C.

4. The apparatus of claim 1, wherein the temperature sense resistors have a sheet resistance of at Least 500 Ω/□ and a temperature coefficient of resistivity of at least 0.0030 Ω/° C.

5. The apparatus of claim 1, wherein the temperature sense resistors have a sheet resistance of at least 1000 Ω/□ and a temperature coefficient of resistivity of at least 0.0040 Ω/° C.

6. The apparatus of claim 1, wherein the temperature sense resistors comprise N-Well material.

7. The apparatus of claim 1, wherein the temperature sense resistors comprise NSD material.

8. The apparatus of claim 1, wherein the temperature sense resistors comprise LDD material.

9. The apparatus of claim 1, wherein the temperature sense resistors comprise PSD material.

10. The apparatus of any claim 1, wherein the inkjet print head chip includes 1–1000 temperature sense resistors.

11. The apparatus of claim 1, wherein each temperature sense resistor is 0.05–5000 μm wide by 0.01–400,000 μm long by 0.05–4 μm thick.

12. The apparatus of claim 1, wherein each temperature sense resistor is 1–2000 μm wide by 1–200,000 μm long by 0.1–3μm thick.

13. The apparatus of claim 1, wherein each temperature sense resistor is 2–1000 μm wide by 2–100,000 μm long by 0.2–2μm thick.

14. The apparatus of claim 13, further comprising an ink jet printer comprising the inkjet print head.

15. The apparatus of claim 1, further comprising an inkjet print head comprising; the inkjet print head chip.

16. A method of controlling the temperature of an inkjet print head chip having a substrate and MOS logic blocks, comprising:

providing the print head chip with at least one substrate heater to heat the chip;

providing the print head chip with a controller of the substrate heater;

implanting temperature sense resistors in the substrate of the chip, wherein the operation of implanting comprises directing a beam of energetic ions incident upon the substrate to embed those ions into the substrate;

operatively connecting the temperature sense resistors to the controller of the substrate heater to enable the controller to monitor the chip temperature to control the substrate heater to heat the chip; and using the controller to control the substrate heater to heat the chip.

17. The method of claim 16, wherein the temperature sense resistors have a sheet resistance of at least 20 Ω/□ and a temperature coefficient of resistivity of at least 0.0010 Ω/° C.

18. The method of claim 16, wherein the temperature sense resistors have a sheet resistance of at least 20 Ω/□ and a temperature coefficient of resistivity of at least 0.0020 Ω/° C.

19. The method of claim 16, wherein the temperature sense resistors have a sheet resistance of at least 500 Ω/□ and a temperature coefficient of resistivity of at least 0.0030 Ω/° C.

20. The method of claim 16, wherein the temperature sense resistors have a sheet resistance of at least 1000 Ω/□ and a temperature coefficient of resistivity of at least 0.0040 Ω/° C.

21. The method of claim 16, wherein the temperature sense resistors comprise N-Well material.

22. The meted of claim 16, wherein the temperature sense resistors comprise NSD material.

23. The method of claim 16, wherein the temperature sense resistors comprise LDD material.

24. The method of claim 16, wherein the temperature sense resistors comprise PSD material.

25. The method of claim 16, wherein the inkjet print head chip includes 1–1000 temperature sense resistors.

26. The method of claim 16, wherein each temperature sense resistor is 0.05–5000 μm wide by 0.01–400,000 μm long by 0.0.5–4 μm thick.

27. The method of claim 16, wherein each temperature sense resistor is 1–2000 μm wide by 1–200,000 μm long by 0.–3 μm thick.

28. The method of claim 16, wherein each temperature sense resistor is 2–1000 μm wide by 2–100,000 μm long by 0.2–2 μm thick.

29. The method of claim 16, further comprising installing the inkjet print head chip in an inkjet print head.

30. The method of claim 29, further comprising installing the inkjet print head in an inkjet printer.

31. The invention of claim 16, wherein the MOS logic blocks are CMOS logic blocks.

* * * * *